United States Patent [19]

Ahmed et al.

[11] Patent Number: 4,931,203

[45] Date of Patent: Jun. 5, 1990

[54] METHOD FOR MAKING AN AUTOMATIC DISHWASHING DETERGENT POWDER BY SPRAYING DRYING AND POST-ADDING NONIONIC DETERGENT

[75] Inventors: Fahim U. Ahmed, Dayton; Charles E. Buck, Caldwell; Michael A. Camara, Jackson; James F. Cush, Jr., Washington Twp., Bergen County; James A. Kaeser, Somerset, all of N.J.

[73] Assignee: Colgate-Palmolive Company, New York, N.Y.

[21] Appl. No.: 330,928

[22] Filed: Mar. 27, 1989

Related U.S. Application Data

[63] Continuation of Ser. No. 223,735, Jul. 15, 1988, abandoned, which is a continuation of Ser. No. 58,297, Jun. 5, 1987, abandoned.

[51] Int. Cl.[5] ..... C11D 3/075; C11D 3/08; C11D 3/395; C11D 11/02

[52] U.S. Cl. ..... 252/99; 252/135; 252/174; 252/174.13; 252/174.21; 252/174.24

[58] Field of Search ..... 252/99, 174.24, 135, 252/174, 90, 174.13

[56] References Cited

U.S. PATENT DOCUMENTS

| | | | |
|---|---|---|---|
| 3,359,207 | 12/1967 | Kaneko et al. | 252/99 |
| 3,922,230 | 11/1975 | Lamberti et al. | 252/89 |
| 3,957,695 | 5/1976 | Davies et al. | 252/532 |
| 4,226,736 | 10/1980 | Bush et al. | 252/135 |
| 4,379,069 | 4/1983 | Rapisarda et al. | 252/135 |
| 4,414,129 | 11/1983 | Joshi | 252/135 |
| 4,428,749 | 1/1984 | Morris | 8/137 |
| 4,549,977 | 10/1985 | Joshi et al. | 252/90 |
| 4,608,188 | 8/1986 | Parker et al. | 252/99 |
| 4,657,693 | 4/1987 | Wise et al. | 252/174.21 |

FOREIGN PATENT DOCUMENTS

| | | |
|---|---|---|
| 1553610 | 10/1979 | United Kingdom . |
| 2095274 | 9/1982 | United Kingdom . |

*Primary Examiner*—Prince E. Willis

*Attorney, Agent, or Firm*—Norman Blumenkopf; Robert C. Sullivan; Murray M. Grill

[57] ABSTRACT

A free flowing, stable, water-soluble, powdered automatic dishwashing detergent with superior solubility, handling and storage characteristics is provided. The compositions comprises an inorganic polyphosphate carrier onto which is absorbed a nonionic detergent. The "loaded" carrier is mixed with powdered silicate and the other usual adjuvants such as bleach, pigment, etc. High levels of detergent are possible without adversely affecting the aforementioned advantages and superior characteristics.

9 Claims, No Drawings

METHOD FOR MAKING AN AUTOMATIC DISHWASHING DETERGENT POWDER BY SPRAYING DRYING AND POST-ADDING NONIONIC DETERGENT

This application is a continuation of application Ser. No. 223,735, filed Jul. 5, 1988, which is a continuation of application Ser. No. 058,297, filed Jun. 5, 1987, both abandoned.

The present invention relates to an improved automatic dishwashing detergent powder with superior performance solubility, pourability, handling and storage characteristics and method for making and using same.

BACKGROUND OF THE INVENTION AND PRIOR ART

In general automatic dishwashing detergent powders contain water soluble builder salt, water-soluble silicate, bleach, preferably a water-soluble chlorine bleaching agent, and water-soluble detergent which is usually an organic, low-foaming (i.e. low "sudsing") non-ionic. For best cleaning efficiency and anti-corrosion effects, the compositions are usually formulated with alkaline salts (i.e. sodium and potassium). In the normal environment in the dishwashing machine, the automatic dishwashing compositions generally yield a pH in the range of about 9.0 to 12.0 and more generally about 9.5 to 11.5. The alkaline builder salts which have been used are both of the inorganic type (e.g. pyrophosphates; carbonates, silicates and so forth) and of the organic type e.g. aminocarboxylates such as trisodium nitrilotriacetate, tetrasodium ethylene diamine tetra-acetate, sodium citrate, sodium itaconate, sodium polymaleate, sodium inter polymaleates, such as maleic-acrylic (or vinyl) interpolymers, sodium oxydisuccinate and so forth.

The builder generally functions to increase the cleaning action of the composition by supplying alkalinity and also by removing (i.e. "sequestering") ions which affect the action and efficiency of the organic detergent.

The silicates which have been used are those wherein the $Na_2O:SiO_2$ ratio varies from 2:1 to 1:4 and more generally from about 1:1 to about 1:3.4, typically 1:1, 1:2 and 1:2.4.

The bleach employed is generally a chlorine-yielding agent and has been used in varying amounts but generally to give available chlorine levels of from about 0.3% to about 10% and, more often, levels of about 1% to 5%. Typical bleaches are the inorganic types such as sodium, lithium and calcium hypochlorite, and chlorinated trisodium phosphate, as well as the organic forms such as the di- and tri- chlorocyanuric acids and their alkali (e.g. sodium and potassium) metal salts, N-chloracetyl urea, 1,3-dichloro-5,5-dimethylhydantoin, etc.

The nonionic detergents in common usage have been any of the conventional hydrophobe moieties (e.g. $C_8$ to $C_{20}$ alcohols, phenols, amides, acids, etc.) reacted with ethylene oxide (or mixtures with other oxyalkylating agents such as propylene oxide or butylene oxide). Typical nonionics used have been n-dodecanol with 10 moles of ethylene oxide; tetradecyl alcohol-hexadecyl alcohol (1:1 weight ratio) with 5, 10, 15 or 20 moles of ethylene oxide; polyoxypropylenes condensed (i.e. terminated) with oxyethylene groups and having the general formula $HO(C_2H_4O)_x(C_3H_6O)_y(C_2H_4O)_zH$ wherein y=5 to 100 and typically 10 or 15 and x & z may be from about 5 to several hundred e.g. 10, 20, 40, 50, etc. Among the latter type of nonionics have been those where the oxyethylene component comprises from about 15% to 90% on a weight basis of the nonionic. Types of non-ionic detergent disclosed as generally useful in automatic dishwashing compositions can be found in U.S. Pat. Nos. 3,314,891, 3,359,207, 2,677,700, 2,979,528, 3,036,118, 3,382,176, 4,115,308 and 4,411,810. It has been known and generally described that non-ionic surfactants even though a preferred class of detergents because of their low-foam characteristics, are not, generally, considered "bleach-stable" detergents and where the latter is of importance use of anionic surfactant, albeit higher foamers, has been reported. Illustrative and a discussion of this problem can be found in U.S. Pat. Nos. 4,116,849, 4,005,027 and 4,235,732.

Automatic dishwashing detergents have been provided in two basic forms, as powders and as "liquids" (or semi-liquids or pastes). The powders represent the "first generation". They are simple to formulate, easy to dispense from machines which have, in the main, been designed to handle powders and not liquids; and because of the presence of the formulation "actives" in solid state, (and usually the components comprise separate and discrete particles), there is a minimum of interaction among the composition ingredients. "Liquids," the so-called "second generation" of products in this area, on the other hand, are more convenient to dispense from the package; also they are generally more soluble in water and therefore have less tendency to remain and/or leave residues in the machine dispenser cup. Phase separation leading to decreased homogeneity and an exacerbation of component interaction are among some of the minuses of the liquid system. Some of the U.S. Patents mentioned earlier are specifically directed to "liquid" systems.

BRIEF DESCRIPTION OF THE INVENTION

The present invention relates to an improved automatic dishwashing detergent in powder form which is highly efficacious, has superior stability, is phase stable and homogeneous and notwithstanding its powder characteristic has many of the advantages of the liquid systems i.e. dispensibility, pourability and solubility without, however, the problems and disadvantages often attending the use of liquid automatic dishwashing compositions.

The compositions of this invention comprise builder salt, generally alkaline builder salt, alkali-metal silicate, non-ionic surfactant and as a preferred optional ingredient, bleaching agent. The product is characterized by a base bead of builder salt having absorbed thereon the non-ionic surfactant, said bead being admixed with the silicate and bleach (where used). Where other optional materials are used they, too, are conveniently post blended with the base beads. These materials may be alkali salts including builder salts, anti-oxidants, dyes, pigments, fragrances, anti-foamers, fillers, sequestering agents, soil suspending agents, drainage improvers and the like.

DETAILED DESCRIPTION OF THE INVENTION

The present invention relates to an improved and superior automatic dishwashing detergent composition in powder form which is free flowing, non-caking, homogeneous, highly soluble and very low, if not entirely free of insolubles and residue when in use, and methods for making and using such compositions.

The outstanding automatic dishwashing compositions which are provided are powders and comprise a base material on which is absorbed or "loaded" a detergent, and in admixture therewith an alkaline silicate and any other desired components. Of particular value is a bleaching agent and alkaline reacting compounds such as alkali carbonates, bicarbonates, borates, hydroxides and so forth.

The base material which is the carrier for the surfactant is a spray-dried phosphate composition which also contains a small amount of a polymeric substance.

The spray-dried base is generally characterized as a "base bead" although it may not necessarily be a bead in the usual geometric form. The absorbent base material is comprised of a major portion of inorganic salts and generally and preferably phosphate material. Suitable phosphates include trisodium phosphate, sodium tripolyphosphate, monobasic sodium phosphate, dibasic sodium phosphate, dibasic sodium pyrophosphate, tetrasodium pyrophosphate, sodium hexametaphosphate and the like. The corresponding potassium salts along with mixtures of sodium and potassium salts are useful. It may be desirable to add other salts to the phosphate such as the alkali metal carbonates, bicarbonates, borates and silicates. The alkaline earth salts (e.g. calcium, magnesium, etc.) of the non-phosphate inorganics may be used if desired and/or indicated. In general, the base "bead" is prepared by spray-drying a slurry of the phosphate-containing composition. The processing of slurries and spray-drying them to form base beads is described in U.S. Pat. No. 4,414,129 to David Joshi and the entire disclosure of this patent is incorporated herein by reference thereto.

The base material will generally comprise from about 50 to 95% alkali-metal polyphosphate. On an anhydrous basis, the base may comprise from about 50% to 99% of inorganic salts and again, preferably alkali metal polyphosphate. Minor amounts of moisture are almost invariably present and the water content may vary from a few or less percent (e.g. 0.5%, 1%, 2%, 3%) to 20% & more but more generally from about 5% to 15%, typically 6%, 8%, 10% and 12%.

Other alkaline salts, particularly sodium carbonate, sodium tetraborate and sodium silicate may be admixed with the phosphate in the crutcher before spray-drying. Generally these materials are used in less than major amounts, generally from very small amounts e.g. 1%, 2%, 5%, up to larger quantities, typically 10%, 15%, 20%, 30%, 35% & 40%. Where silicate is used in the crutcher mix it is usually one of lesser alkalinity e.g. $Na_2O:SiO_2$ ratio of about 1:1.6 to 1:3.4 typically 1:2.4.

A second essential component of the base bead is a water-soluble polymeric material such as sodium polyacrylate, which is the most preferred polymer salt. Other water-soluble polymers (at least soluble in such salt form) as poly (hydroxy) acrylates, copolymers and interpolymers of acrylic acid with other copolymerizable monomers (usually α; B-olefinically unsaturated) such as vinyl pyrrolidone, vinyl acetate, hydrolyzed polyvinyl acetate (75–95% polyvinyl alcohol), acrylamide, methyl vinyl ether and so forth can be used. Other polymers include water-soluble forms of starch and cellulose and particularly derivatives such as sodium carboxymethylcellulose and the like. Natural proteins are useful, too; examples include gelatin and the like. In general, the useful materials are characterized by water-solubility and compatibility to form a base carrier suitable for loading the detergent in quantities from 1 to about 10% and where desired up to quantities of 25–35%. Such polymers are useful in amounts of from about 0.5% to about 10% and preferably from about 1% to 8%. Typical usage would be 1.5%, 2%, 2.5%, 3%, and 4%, especially with sodium polyacrylate. The molecular weights of the synthetic polymers may vary from several hundred to several million, e.g. 600; 1200; 2000; 5000; 150,000; 500,000; 1,000,000; 5,000,000 and the like.

After the base bead has been prepared, it is used as an absorbent or carrier for the detergent. The latter are preferably non-ionic surfactants which, in liquid form are sprayed onto the base beads. The more desirable non-ionic detergent materials are generally pasty to waxy at room temperature or at least sprayable as a liquid at somewhat elevated temperatures e.g. 30° C., 40° C., 60° C., 80° C. and 100° C.

The non-ionic detergent materials comprise any of the class designated as non-ionic and generally comprise the oxyalkylated derivatives (preferably oxyethyl or mixed oxypropyl oxyethyl) of hydrophobic base moieties of about $C_8$ to $C_{30}$ carbon content of such functional types as alcohols, thioalcohols, esters, acids and amides. The preferred compounds are oxyethylated and mixed oxypropylated-oxyethylated aliphatic alcohols of $C_{10}$ to $C_{18}$.

The non-ionic detergents are the preferred types because of their physical characteristics; liquifiable and sprayable as well as low foaming; one of the major characteristics of a detergent which adversely affects the cleaning efficacy of the dishwashing composition is a high level of foam. This is due primarily to the fact that the cleaning action is proportional to the force of the jets of water impinging on the dishes, etc., and high levels of foam and thick or dense foam reduce this force and thusly the cleaning action.

A general formula for preferred non-ionics is:

$$R\text{-}(OCH_2\overset{\overset{R_1}{|}}{C}H)_n\text{-}OH \qquad \text{I.}$$

wherein R=hydrogen or $C_{10}$ to $C_{18}$ alkyl and preferably linear alkyl. $R_1$ is hydrogen or methyl and n=an integer from 2 to 150, preferably 5 to 50 and more preferably 5 to 20. Where R is hydrogen the oxyalkyl groups are oxypropyl as a hydrophobe backbone with oxyethyl or oxyethyl and oxypropyl terminating groups.

Compounds where R is hydrogen generally have the following formula:

$$HO\text{-}(CH_2CH_2O)_q\text{-}(CH_2\overset{\overset{CH_3}{|}}{C}HO)_m\text{-}(CH_2CH_2O)_p\text{-}H \qquad \text{I.}$$

where m may range from 3 to 50 or more and p and q may range similarly as n in Formula I.

Illustrative compounds include:

(1) n-tridecanol+7. E.O. *

(2) n-tetradecyl alcohol+8. E.O.

(3) n-hexadecylalcohol+8. E.O.

(4) a $C_{12}$–$C_{14}$ linear alcohol containing 55% oxyalkyl of which 42% are ethoxy and 58% proproxy in a randon distribution.

(5) A $C_{18}$ alkyl linear alcohol containing 57% ethylene oxide.
* E.O.=ethylene oxide $$H(OCH_2CH_2)_5(OCH_2\overset{\overset{CH_3}{|}}{C}H)_{10}(OCH_2CH_2)_5OH \quad (6)$$

Mixed carbon chain lengths are often, and typically, used since they are very often quite readily available as mixtures from both synthetic and natural sources.

The amount of non-ionic may range from a few percent up to 35 to 40% on a weight for weight basis. It is preferred to use at least about 3 to 4%. Typical amounts would be 4%, 6%, 8% and in some embodiments 20%, 25% and 30%. Where high non-ionic loading is desired, then it is preferred to utilize some of the formula-inorganic polyphosphate as post added in anhydrous (or very low moisture content e.g. 1%, 2% or 3%) form.

In general, while other inorganic alkaline materials may be used in preparing the non-ionic carrier phosphate bead, it is usually less desirable to use silicate at least as a major replacement for the polymer if not as only a minor replacement for the polymer materials, and the silicate where employed in this invention for its alkalinity and anti-corrosive benefits is best utilized as a post added component.

The silicates which are used in the compositions of the present invention and particularly those which are post added as powders comprise any of the commercially available alkali silicates available as powders, wherein the $Na_2O$ to to $SiO_2$ molar ratio varies from 2:1 to 1:4 and preferably varies from 1:1 to 1:3.5. Typical and most preferred silicates are sodium and potassium silicates where the $Na_2O$ to $SiO_2$ molar ratio varies from 1:1 to 1:2.5 and especially the metasilicates (1:1 ratio).

The physical form of the particulate silicate may be any form i.e. any density, porosity, shape and particle size. Thus densities may range from a bulk density of 0.3 or 1.5 and preferably 0.4 or 0.5 to 0.7 or 0.8, 0.9 or 1.0.

Typical particle sizes for the post added silicates may be a product of 20, 30, 40, 50, 60 mesh. A commercially available product with 80–85% or more between 40 & 60 mesh is very useful. Similarly a product with 84% between 10 & 65 mesh is excellent.

One additional and particularly outstanding characteristic and feature of one aspect of the compositions of this invention is their relative low bulk density as compared to the usual commercial products. Thus for example, while commerical products may have densities of the order of 0.8 those of the present invention may be made having 20 to 50% less density.

The silicates used may be in the form of beads, hollow or otherwise, finely divided powder, regular and irregular and diverse shaped particles. Particularly preferred silicates are available as Metsobeads from PQ Corporation and Britesil LD24. Mixtures of any of the foregoing may also, of course, be used.

The amount of silicate used may very from a few percent to a significant and almost major amount such as 2%, 3% and 5% to 10%, 15%, 20%, 30% and 40%. Particularly preferred ranges are 5% to 25% and 5% to 15%.

The optional bleach which, however, is highly desirable and preferred can be any of those conventionally used in autodish compositions. The chlorine bleaches described earlier in the "Background of the Invention and Prior Art" section can also be used in this invention. Similar amounts may be used as e.g. 0.3% to about 10%, preferably 1% to 5% (by weight). In place of chlorine-yielding (e.g. $OC^{1-}$) bleaches, one may use oxygen bleaches such as sodium perborate monohydrate, sodium perborate tetrahydrate, sodium persulfate, sodium percarbonate and so forth. Oxygen bleach levels may range from about 2% to 40 or 50% and preferably from about 5% to 30%.

Many other adjuvants may be added to the present compositions without adversely affecting their utility and performance. For example, bacteriocides, enzymes, anti-spotting agents, sheeting agents, glaze-damage inhibitors (e.g. boric acid anhydride) may be used in amounts from as little as 0.01% to 10%, 15% or more.

The following examples will serve to illustrate the present invention without being deemed limitative thereof. Parts, where used, are by weight unless otherwise indicated.

EXAMPLE I

An aqueous slurry of anhydrous sodium tripolyphosphate powder, (TPP) water and sodium polyacrylate powder is prepared at 45% solids level, handled and spray dried as in Example 1 of Joshi U.S. Pat. No. 4,414,129. Of the spray dried product the TPP comprises 89.55%, the polyacrylate 2.45% and the balance of 8% is moisture in the bead. The bead has a specific gravity of 0.5 and has considerable mechanical strength.

The beads so produced are introduced into a rotary drum and post sprayed with a non-ionic surfactant (liquefied) at a temperature of 120° F. until 6% by weight of the non-ionic has been "loaded" on the carrier beads. The non-ionic is a $C_{12}$–$C_{14}$ linear alcohol containing about 55% of random oxyethyl and oxypropyl groups (42 wt. % oxyethyl–58 wt. % oxypropyl groups). These groups are introduced into the alcohol using a mixed ethylene oxide-propylene oxide stream. The beads at the time of spraying are at a temperature of about 100° to 105° F. (38° to 41° C). 680 g of the "loaded" beads are then dry mixed with 125 g of powdered sodium metasilicate (PQ Corporation Metsobeads), 102 grams of anhydrous sodium carbonate and 33 g of sodium dichloroisocyanurate dihydrate.

In use in an automatic dishwasher, 37 g of the above formulation are used (in lieu of 50 g of "A" commercial autodish powder). Excellent cleansing is obtained. The spotting and filming performance is better than "A" commercial, state of the art powder.

EXAMPLE II

Example I is repeated except that the beads are loaded with 25% by weight of the non-ionic and the composition is varied somewhat to have the following components:

| | WT. % |
|---|---|
| Based Beads of Ex. 1 | 60.0 |
| Sodium metasilicate* | 12.0 |
| Sodium carbonate of Ex. 1 | 10.0 |
| Nonionic of Ex. 1 | 15.0 |
| Cl. bleach of Ex. 1 | 3.0 |
| | 100.0% |

*the metasilicate used here is a high bulk density product (50 lbs/ft$^3$)

EXAMPLE III

Example II is repeated except that the amount of base beads is only 50% (and, therefore, non-ionic is only 12.5%). The additional "hole" of 12.5% in the formula is filled with sodium tripolyphosphate (anhydrous) which is post mixed and blended into the formula with the metasilicate, carbonate and bleach.

EXAMPLE IV

The previous examples are repeated using as the non-ionic in each instance, the following:

(a) $C_{18}$ linear alcohol containing 57% condensed ethylene oxide, (b) Olin SLF-18-polytergent, (c) n-tetradecylalcohol+8 moles of ethylene oxide.

In preparing the composition of this invention, the usual equipment may be used. Examples include Patterson Kelly twin shell blender for batch operation and a Patterson Kelly Zig-Zag blender for continuous processing.

Tower conditions and operating parameters for producing the non-ionic carrier-beads are fully described in the incorporated U.S. Pat. No. 4,414,129.

We claim:

1. A method for making a free-flowing automatic dishwashing composition comprising preparing an aqueous slurry of water-soluble inorganic phosphate and a minor amount of a water-soluble polymer, spray drying said slurry to form essentially hollow beads, absorbing thereon from 2% to 40% by weight based on the weight of the beads of a non-ionic surfactant having a melting point below about 150° C. by spraying said non-ionic in liquefied form onto said beads and thereafter dry mixing said beads with powdered sodium silicate in an amount of 2% to 40% by weight.

2. A method according to claim 1, wherein the phosphate is sodium tripolyphosphate, the non-ionic is a $C_{10}$–$C_{18}$ linear alcohol containing at least 5 moles of condensed ethylene oxide and the silicate is sodium metasilicate.

3. A method according to claim 1, wherein the polymer is a polyacrylate and comprises 0.5% to 10% by weight of the total components.

4. A method according to claim 3, wherein a bleaching agent is added during the dry mixing step.

5. A method according to claim 4, wherein the bleaching agent is a chloroisocyanurate or an alkali or calcium hypochlorite.

6. A method according to claim 1, wherein the resulting composition has a bulk density of from 0.4 to 0.64, in terms of specific gravity.

7. A method according to claim 2, wherein the resulting composition has a bulk density of from 0.4 to 0.64, in terms of specific gravity.

8. A method for cleaning dishes and the like in an automatic dishwasher which comprises adding to the dishwasher, a free-flowing composition made in accordance with the method of claim 1 and thereafter putting the machine through its normal washing cycle.

9. The method of claim 8 wherein the free-flowing composition is added to the dispenser means of the automatic dishwasher.

* * * * *